US005974609A

United States Patent [19]

Nunez et al.

[11] Patent Number: 5,974,609

[45] Date of Patent: Nov. 2, 1999

[54] QUILT TOP MATTRESS WITH CONVOLUTED FOAM CUSHION

[75] Inventors: Antonio Nunez, Flemington, N.J.; Bob A. Steelman, Richmond, Va.

[73] Assignee: The Spring Air Company, Des Plaines, Ill.

[21] Appl. No.: 09/106,240

[22] Filed: Jun. 29, 1998

[51] Int. Cl.[6] ..... A47C 23/04

[52] U.S. Cl. ..... 5/717; 5/721

[58] Field of Search ..... 5/691, 716, 717, 5/721, 727, 730, 731, 736, 901, 903, 737, 740

[56] References Cited

U.S. PATENT DOCUMENTS

| | | | |
|---|---|---|---|
| D. 316,202 | 4/1991 | Farley . | |
| D. 336,400 | 6/1993 | Mitchell et al. | D6/596 |
| D. 352,858 | 11/1994 | Farley . | |
| D. 383,349 | 9/1997 | Steelman et al. . | |
| 2,902,091 | 9/1959 | Dahle . | |
| 3,197,357 | 7/1965 | Schulpen . | |
| 3,311,007 | 3/1967 | McGee . | |
| 3,431,802 | 3/1969 | Schulpen . | |
| 3,690,203 | 9/1972 | Huttemann . | |
| 3,695,128 | 10/1972 | Gentile . | |
| 3,730,031 | 5/1973 | Huttemann . | |
| 3,828,378 | 8/1974 | Flam . | |
| 4,335,476 | 6/1982 | Watkin . | |
| 4,351,211 | 9/1982 | Azzolini . | |
| 4,392,489 | 7/1983 | Wagner, Sr. . | |
| 4,522,447 | 6/1985 | Snyder et al. . | |
| 4,550,547 | 11/1985 | Wagner, Sr. . | |
| 4,603,445 | 8/1986 | Spann . | |
| 4,620,337 | 11/1986 | Williams et al. . | |
| 4,672,700 | 6/1987 | Poncy . | |
| 4,673,452 | 6/1987 | Awdhan . | |
| 4,679,266 | 7/1987 | Kraft . | |
| 4,686,724 | 8/1987 | Bedford . | |
| 4,741,058 | 5/1988 | Williams et al. . | |
| 4,879,776 | 11/1989 | Farley . | |
| 4,955,095 | 9/1990 | Gerrick . | |
| 5,010,609 | 4/1991 | Farley . | |
| 5,038,433 | 8/1991 | Farley . | |
| 5,077,849 | 1/1992 | Farley . | |
| 5,111,542 | 5/1992 | Farley . | |
| 5,134,735 | 8/1992 | Rose | 5/730 |
| 5,136,740 | 8/1992 | Kraft . | |
| 5,172,439 | 12/1992 | Farley . | |
| 5,178,811 | 1/1993 | Farley . | |
| 5,317,768 | 6/1994 | Klancnik . | |
| 5,430,901 | 7/1995 | Farley . | |
| 5,469,590 | 11/1995 | Simon | 5/721 |
| 5,579,549 | 12/1996 | Selman et al. | 5/721 |
| 5,787,532 | 8/1998 | Langer et al. | 5/717 |

*Primary Examiner*—Terry Lee Melius
*Assistant Examiner*—James M. Hewitt
*Attorney, Agent, or Firm*—Wood,Phillips, VanSanten, Clark & Mortimer

[57] ABSTRACT

A quilt top mattress comprises a spring unit and a cover fabric layer surrounding the spring unit. A quilt top layer overlies the fabric layer. The quilt top layer comprises an outer fabric layer, a fiber batt layer, a convoluted foam cushion and an inner fabric layer, all being secured together by stitching to define a select quilt pattern. The convoluted foam cushion has a planar outer surface in contact with the fiber batt layer, and a convoluted inner surface defined by alternating peaks and valleys, the inner surface facing the spring unit. A fabric flange secures a perimeter edge of the quilt top layer to a corner edge of the cover fabric layer.

27 Claims, 3 Drawing Sheets

QUILT TOP MATTRESS WITH CONVOLUTED FOAM CUSHION

FIELD OF THE INVENTION

This invention relates to a mattress and, more particularly, to a quilt top mattress including a convoluted foam cushion.

BACKGROUND OF THE INVENTION

A mattress, in its most basic form, comprises a spring unit surrounded by a cover fabric layer. Various layers of foam and/or upholstery fabrics may be included between the cover fabric layer and the spring unit to provide varying degrees of comfort. Firmness of the mattress is generally determined by firmness of coils in the spring unit.

Additional comfort in a mattress construction may be provided by a "pillow top" or "quilt top". Such a mattress has a pillow or quilt sewn to both the top and bottom of the mattress. The quilt top may itself include fabric ticking, cloth or fiber layers and foam layers. Use of convoluted foam cushions are known in the quilt top layer of mattresses. In such known constructions, the convoluted foam cushion has peaks and valleys facing upwardly. As a result, the peaks may "poke" through a fiber layer, separating the fibers and causing them to rest in the valleys between the peaks. This can adversely affect the uniformity of the fiber layer. Also, the peaks can be felt through the fiber layer and the mattress outer fabric layer, giving the mattress a bumpy feel.

The present invention is directed to solving one or more of the problems discussed above in a novel and simple manner.

SUMMARY OF THE INVENTION

In accordance with the invention there is provided a quilt top mattress including a convoluted foam cushion in a quilt top layer which enhances durability and user comfort.

Broadly, there is disclosed herein a quilt top mattress comprising a spring unit and a cover fabric layer surrounding the spring unit. A quilt top layer overlies the fabric layer. The quilt top layer comprises an outer fabric layer, a fiber batt layer, a convoluted foam cushion and an inner fabric layer, all being secured together by stitching to define a select quilt pattern. The convoluted foam cushion has a planar outer surface in contact with the fiber batt layer, and a convoluted inner surface defined by alternating peaks and valleys, the inner surface facing the spring unit. A fabric flange secures a perimeter edge of the quilt top layer to a comer edge of the cover fabric layer.

It is a feature of the invention that the convoluted foam cushion is of polyethylene foam construction.

It is another feature of the invention to provide an insert layer disposed between the cover fabric layer and the quilt top layer. The insert layer comprises a second convoluted foam cushion having a planar inner surface and a convoluted outer surface. The second convoluted foam cushion may be of polyethylene foam construction, latex foam construction, or visco-elastic latex foam construction.

It is a further feature of the invention to provide an inner convoluted foam cushion disposed between the spring unit and the cover fabric layer having an inner planar surface and a convoluted outer surface.

In accordance with a further aspect of the invention there is provided a convoluted foam cushion which increases comfort or softness. The elongate convoluted cushion supports a recumbent human body. The cushion comprises an elongate body including an area formed by generally longitudinally extending ribs arranged in rows. Each rib is separated from any adjacent rib by a channel. Each rib includes a plurality of first peaks having a first height and a plurality of second peaks having a second height, different from the first height. The first and second peaks are alternatingly disposed along each rib.

It is a feature of the invention that each rib is generally sinusoidal about a longitudinal axis to define sinusoidal channels therebetween. The first peaks are formed at crests of the sinusoidal ribs. The second peaks are formed at the longitudinal axis of each rib. The ribs are wider in areas proximate the first and second peaks. The first and second peaks are rounded.

It is another feature of the invention that the first height is greater than the second height. It is a further feature of the invention that the channels have a first thickness in areas proximate the first peaks and a second thickness in areas proximate the second peaks. The second thickness is greater than the first thickness.

There is disclosed in accordance with yet another aspect of the invention an elongate convoluted cushion comprising alternating support zones and comfort zones. The support zones provide a first amount of support. The comfort zones provide a second amount of support. The first amount of support is greater than the second amount of support.

It is a feature of the invention that the cushion is bidirectional.

It is another feature of the invention that the support zones are formed by generally longitudinally extending ribs arranged in rows, with each rib separated from any adjacent rib by a channel. Each rib includes a plurality of first peaks having a first height and a plurality of second peaks having a second height. The first and second peaks are alternatingly disposed along each rib.

It is an additional feature of the invention that the comfort zones are formed by a plurality of third peaks having a third height, the third peaks being arranged in rows. Each of the third peaks is separated from any adjacent third peak in a same row by a valley. The third peaks in adjacent rows are staggered to form a checkerboard pattern.

It is a further feature of the invention that the third peaks are rounded.

It is another feature of the invention that the second height is greater than the first height.

It is yet an additional feature of the invention that the valleys in the comfort zone have a thickness greater than a thickness of channels in the support zone.

Further features of the invention will be readily apparent from the specification and from the drawing.

DETAILED DESCRIPTION OF THE INVENTION

Figure 1:
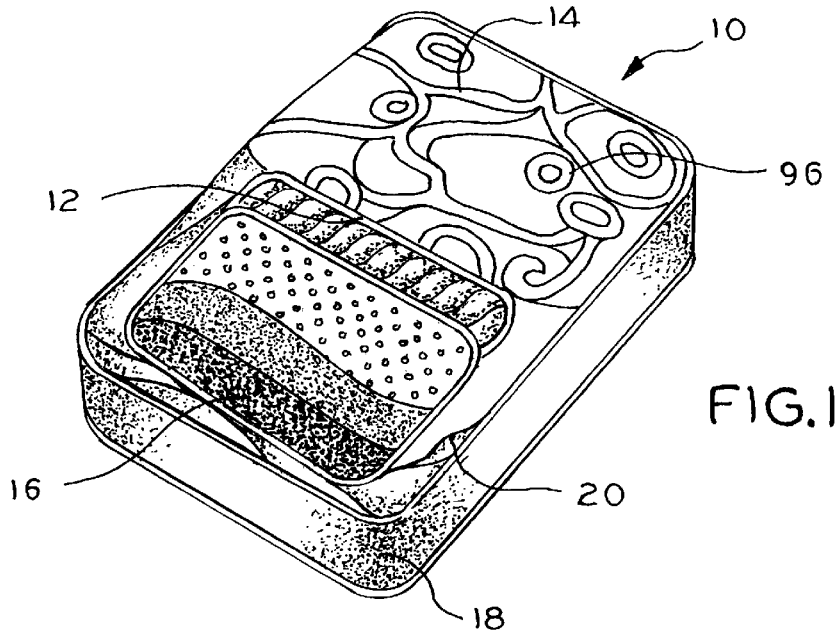
FIG. 1 is a perspective view of a quilt top mattress according to the invention, with parts removed for clarity.
Figure 2:
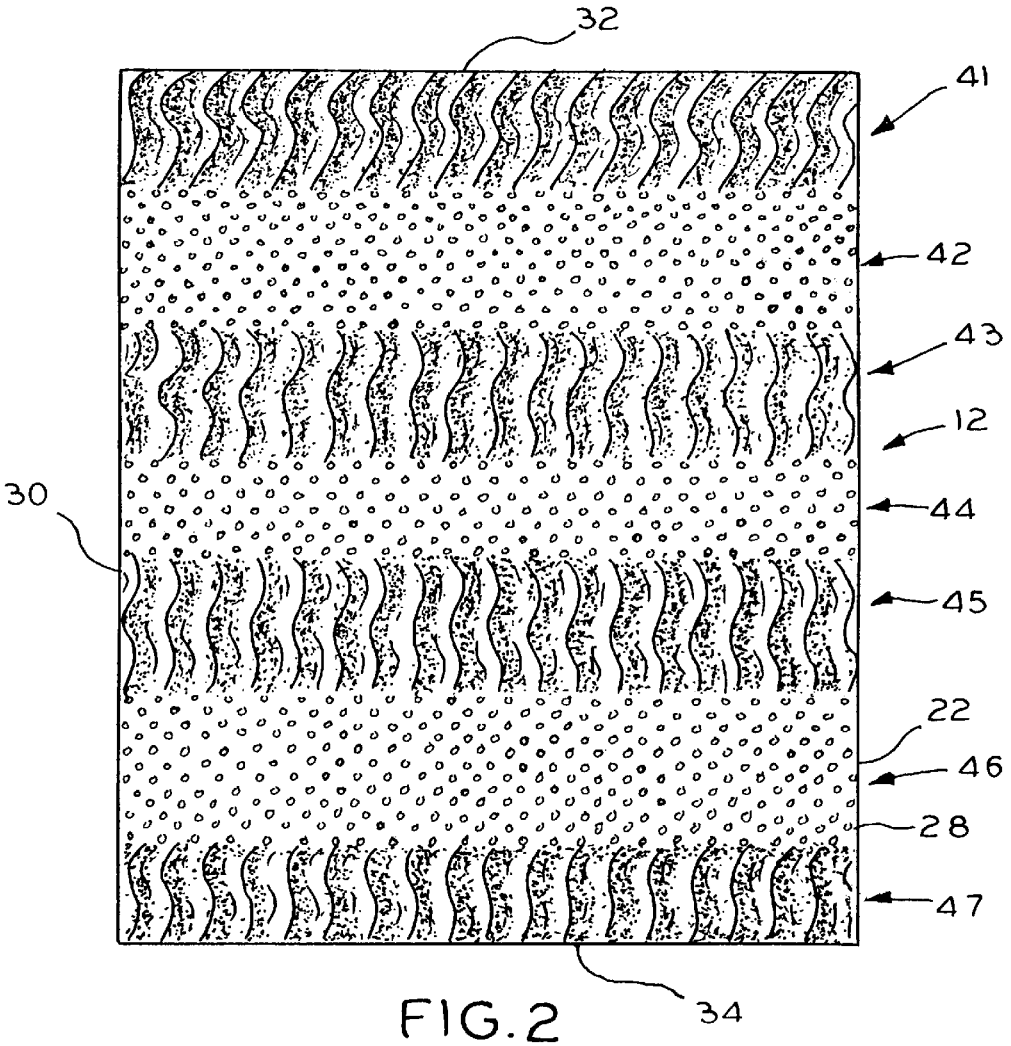
FIG. 2 is a plan view of a convoluted foam cushion of the mattress of FIG. 1.
Figure 3:
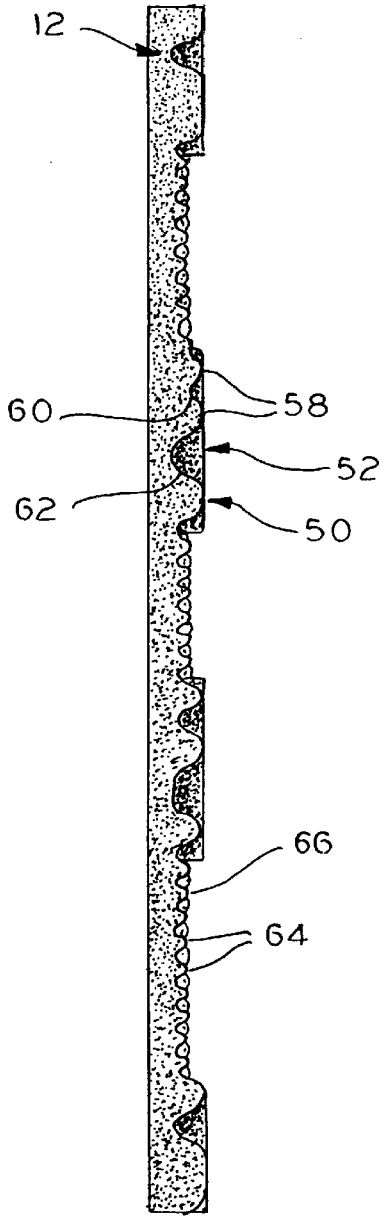
FIG. 3 is a left side view of the cushion of FIG. 2.
Figure 4:
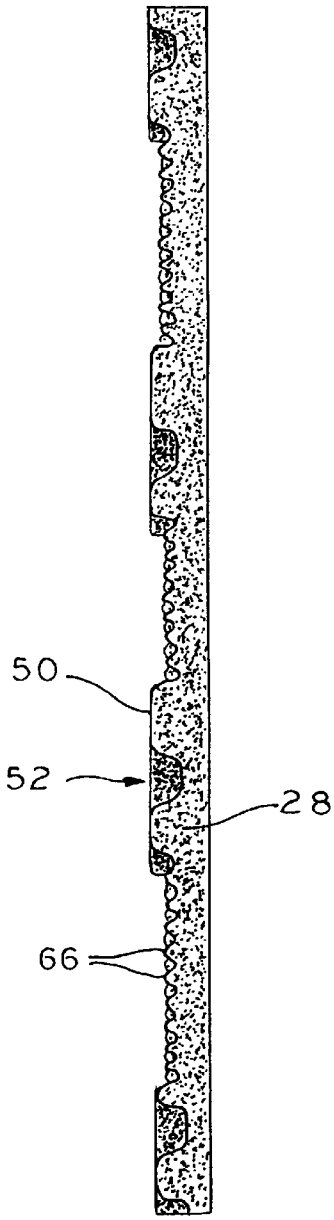
FIG. 4 is a right side view of the cushion of FIG. 2.
Figure 5:
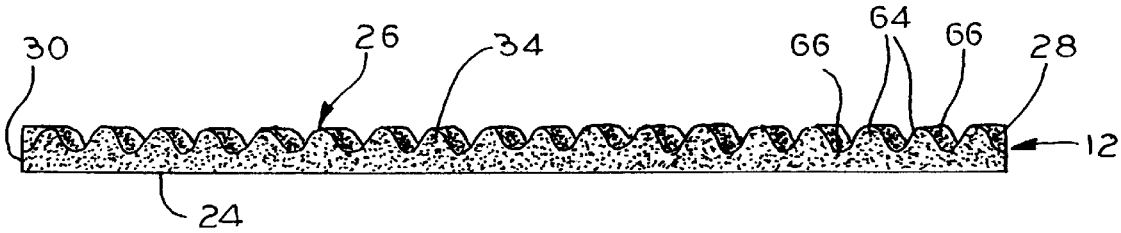
FIG. 5 is a head end view of the cushion of FIG. 2.

Referring initially to FIG. 1, there is illustrated a mattress 10 including a convoluted foam pad or cushion 12 disposed in a quilt top layer 14 according to the invention. Overall, the mattress 10 is generally conventional in construction and includes an inner spring unit 16 surrounded by a cover fabric layer 18. As described more particularly below, the quilt top layer 14 is secured to the cover fabric layer 18 via a fabric flange 20.

The cushion 12 is configured to provide comfort and support to a human body by adjusting to the anatomic shape of the body. Particularly, the cushion 12 is divided into seven zones having select convoluted pattern configurations.

Referring to FIGS. 2–5, the cushion 12 is illustrated in greater detail. The cushion 12 comprises an elongate rectangular body 22 including a generally flat bottom surface 24 and convoluted top surface 26. The body 22 is cut at opposite side edges 28 and 30 and opposite ends 32 and 34.

The body 22 is defined by seven rectangular zones 41, 42, 43, 44, 45, 46 and 47. The zones 41–47 are longitudinally spaced. The width of each zone corresponds to the width of the body 22. The zones 41, 43, 45 and 47 comprise support zones. The zones 42, 44 and 46 comprise comfort zones. The support zones 41, 43, 45 and 47 alternate with the comfort zones 42, 44 and 46. The support zones 41, 43, 45 and 47 provide a first amount of support. The comfort zones 42, 44 and 46 provide a second amount of support. Particularly, the first amount of support is greater than the second amount of support.

Figure 6:
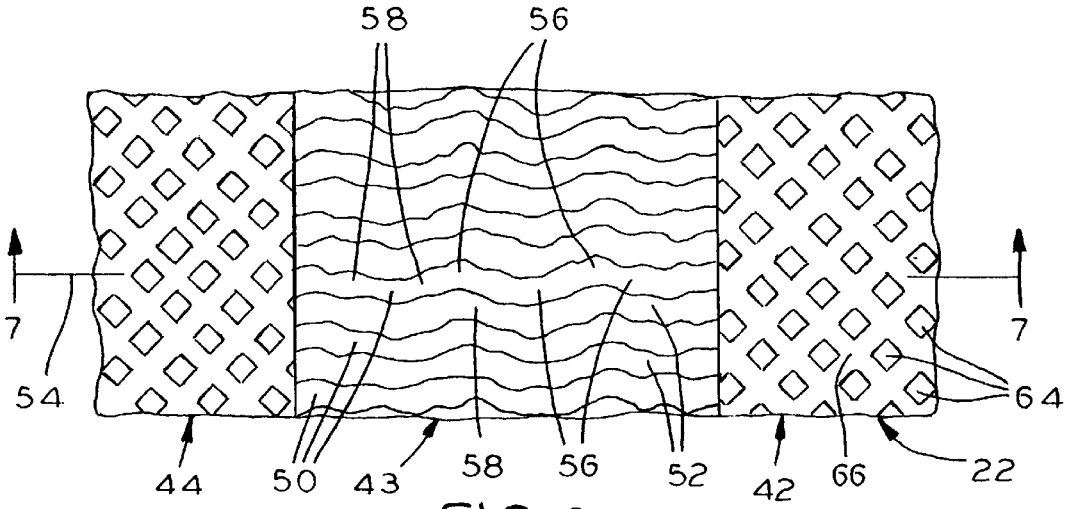
FIG. 6 is a partial, detailed view of a portion of the cushion of FIG. 2.
Figure 7:
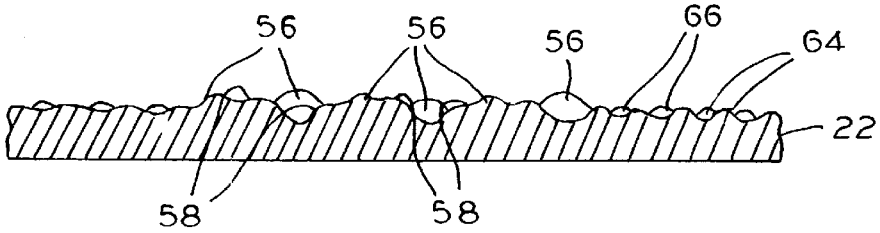
FIG. 7 is a sectional view taken along the line 7—7 of FIG. 6.

Referring now to FIGS. 6 and 7, a portion of the body 22 is illustrated in greater detail. Particularly, these figures illustrate portions of the support zone 43 and the opposite adjacent comfort zones 42 and 44. As is apparent, each of the support zones 41, 43, 45 and 47 are identical in construction. Likewise, the comfort zones 42, 44 and 46 are identical in construction. Thus, the description relative to the section shown in FIGS. 6 and 7 carries over to the zones throughout the entire cushion 12.

The support zone 43 includes a plurality of generally longitudinally extending ribs 50 arranged in rows. Each rib 50 is separated from any adjacent rib 50 by a channel 52. Each rib 50 is generally sinusoidal about a longitudinal axis. A representative longitudinal axis is indicated by a line 54 associated with one of the ribs 50. Thus, each of the channels 52 is likewise sinusoidal. Each rib 50 includes a plurality of first peaks 56 and a plurality of second peaks 58. The first peaks 56 and second peaks 58 are alternately disposed along each rib 50. Particularly, the first peaks 56 are formed at crests of the sinusoidal ribs, i.e., the portion of each rib 50 furthest from the longitudinal axis 54. The second peaks 58 are formed at the longitudinal axis 54 of each rib 50. The ribs 50 are wider in areas proximate the peaks 56 and 58. The peaks 56 and 58 are generally rounded at their tops. The height of the first peaks 56 is greater than the height of the second peaks 58. The ribs 50 are wider in areas proximate the first peaks 56 than areas surrounding the second peaks 58.

The thickness of the body 22 at the channels 52 also differs alongside each rib 50. Particularly, referring to FIG. 3, as can be seen the cushion 12 is thicker in the channel 52 at 60 proximate the second peaks 58 than at 62 proximate the first peak 50.

The comfort zones, such as the comfort zone 42, is formed by a plurality of third peaks 64. The peaks 64 are arranged in longitudinal rows. Each of the third peaks 64 is longitudinally spaced from other peaks in the same row. Each of the adjacent rows is staggered to form a checkerboard pattern as illustrated. The third peaks 64 are also rounded at their tops, as illustrated in FIG. 7. The height of the third peaks 64 is lower than the height of the first peaks 56 and second peaks 58. The third peaks 64 are separated by valleys 66. The cushion at the valley 66 has a thickness greater than the thickness of the support zone channels 52.

In the illustrated mattress configuration, the first zone 41 provides support to the head and neck area. The second zone 42 provides comfort to the shoulder area. The third zone 43 provides support to the lower back area. The fourth zone 44 provides comfort to the hips and upper buttocks area. The fifth zone 45 provides support to the lower buttocks and thigh area. The sixth zone 46 provides comfort to the calf and leg area. Finally, the seventh zone 47 provides support to the lower leg, ankle and foot area. The fourth zone 44 is centrally positioned in the body 22. The third and fifth zones 43 and 45 are of identical size, as are the first and seventh zones 41 and 47. Also, the second and sixth zones 42 and 46 are of identical size. Thus, the cushion 22 is bidirectional. This allows the cushion 12 to be turned in the opposite longitudinal direction. Likewise, the mattress 10 can be periodically rotated on a regular basis.

The cushion 12 can be constructed of polyethylene foam or one hundred percent latex. The cushion 12 provides for improved circulation and reduces pressure points, resulting in less tossing and turning. The cushion 12 provides better conformance than traditional planar foam. The peaks and valleys coupled with the softness of the cushion 12 provides an immediate response to the distribution of body weight and body pressure, therefore providing comfort and softness, while adjusting to the anatomic shape of the body. The use of the convolutions in the top surface 26 increases the comfort or softness of the resulting mattress 10. This is attributed to the various heights and depths found in the different zones, which provides a range of firmness within the mattress 10.

Particularly, the comfort zones 42, 44 and 46 are thinner in overall size. The support zones 41, 43, 45 and 47 are slightly raised. The increased thickness provides improved support. This higher support is attributed to the varying heights in the pattern. On average, the support zones 41, 43, 45 and 47 are thirty percent higher than the comfort zones 42, 44 and 46. The comfort zones assist in the overall comfort of the cushion 12. The firmness of the comfort zones 42, 44 and 46 are ten percent higher than in the support zones 41, 43, 45 and 47.

Figure 8:
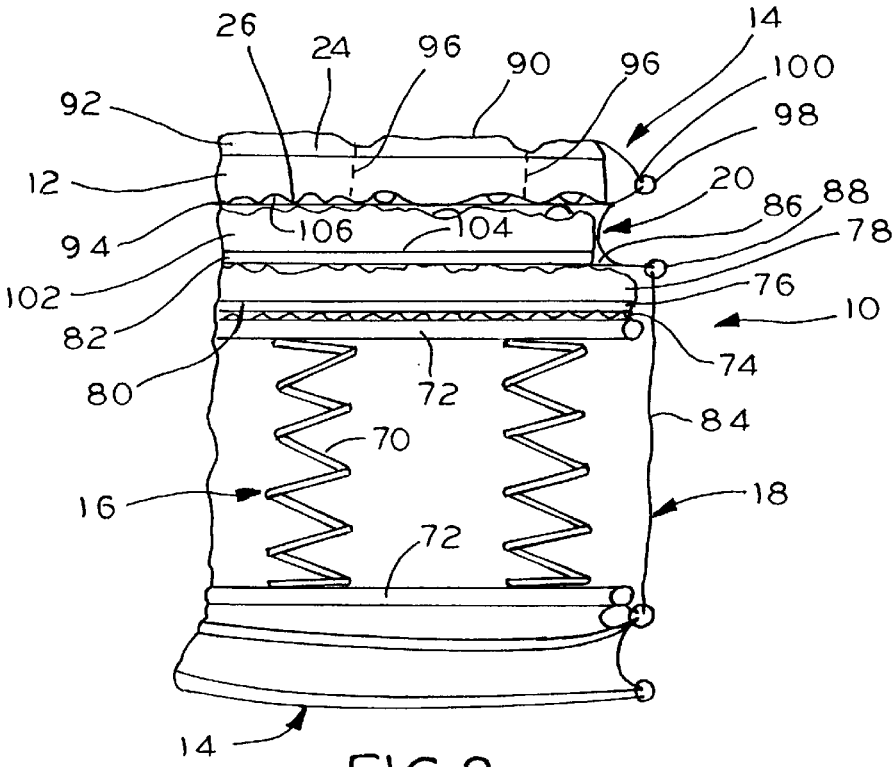
FIG. 8 is a side end view of a portion of the mattress of FIG. 1, again with parts removed for clarity.

Referring to FIG. 8, the construction of the mattress 10, including the cushion 12 in the quilt top 14 is illustrated in greater detail.

The spring unit 16 comprises a plurality of coils 70 interconnected in a conventional manner and surrounded by upper and lower corner rods 72. The specific structure of the spring unit 16 is conventional in nature.

To enable the mattress 10 to be reversible, both the top and bottom of the mattress are of similar construction. Only the top of the mattress, as viewed in FIG. 8, is described in detail herein. Nevertheless, as will be appreciated, the same structural features are provided at the bottom of the mattress. It should be understood that whether the portion is defined as the top or bottom depends on placement of the mattress at any given time.

A mesh sleep shield 74 of conventional construction overlies the spring unit 16. A planar foam layer 76 rests atop the sleep shield 74. An inner convoluted foam cushion layer 78 rests atop the planar foam layer 76. The convoluted foam layer 78 may be of similar construction to the convoluted foam cushion 12, discussed above. The convoluted foam cushion 78 is oriented with an inner planar surface in contact with the foam layer 74 and an outer convoluted surface facing upwardly.

The inner spring unit, the sleep shield 74 and foam layers 76 and 78 are completely surrounded by the cover fabric layer 18. The cover fabric layer 18 comprises a quilted fabric side panel 84 surrounding the peripheral side of the mattress and a fabric ticking 86 outwardly of the convoluted foam cushion 78. The side panel 84 is secured to the fabric ticking 86 via a binding 88, as is conventional.

Although the illustrated mattress 10 includes the first foam layer 76 and the convoluted foam cushion 78, these components could be replaced with conventional upholstery components, as will be apparent.

The quilt top layer 14 overlies the fabric ticking 86. The quilt top layer 14 comprises an outer fabric layer or ticking 90, a fiber batt layer 92, the convoluted foam cushion 12, and an inner fabric layer 94. The layers 90, 92, 12 and 94 are secured together by stitching, represented at 96, defined by a select quilt pattern as particularly seen in FIG. 1.

In accordance with the invention, the convoluted foam cushion 12 is oriented with the generally flat surface 24 facing outwardly in contact with the fiber batt layer 92. The convoluted surface 26 faces inwardly towards the spring unit 16. This particular orientation of the convoluted foam cushion 12 with the peaks and valleys pointing downward results in increased durability, better consumer appeal, and increased user comfort.

In addition to the quilt stitching 96, the outer fabric layer 90 and inner fabric layer 94 are secured together about the peripheral edge using a binding 98 and stitching 100. As is seen, the fabric flange 20 is secured to the binding 98 as well as the binding 88 to secure the perimeter edge of the quilt top layer 14 to the cover fabric layer 18.

In the illustrated embodiment of the invention, an insert layer 102 is disposed between the cover fabric layer 86 and the quilt top layer 14. The insert layer 102 comprises a convoluted foam cushion. The convoluted foam cushion 102 is similar to the convoluted foam cushion 12, except that a planar surface 104 faces inwardly, while a convoluted surface 106 faces outwardly, toward the quilt top layer 14.

In accordance with the above, the inner convoluted foam cushion 78 and insert convoluted foam cushion 102 may be of latex, visco-elastic latex, or polyethylene foam construction. The quilt top convoluted foam cushion 12 is of polyethylene foam construction.

Thus, in accordance with the invention the mattress 10 is provided with a convoluted foam cushion in the quilt top layer with peaks pointed downward to provide increased durability, better consumer appeal and increased user comfort. Moreover, the convoluted foam cushion provides select comfort zones to assist in overall comfort and support zones to provide increased firmness in select zones.

We claim:

1. A quilt top mattress comprising:

a spring unit;

a cover fabric layer completely surrounding the spring unit;

a quilt top layer overlying the fabric layer, the quilt top layer comprising an outer fabric layer, a fiber batt layer, a convoluted foam cushion and an inner fabric layer, all being secured together by stitching to define a select quilt pattern, the convoluted foam cushion having a planar outer surface in contact with the fiber batt layer, and a convoluted inner surface defined by alternating peaks and valleys, the inner surface facing the spring unit; and a fabric flange securing a perimeter edge of the quilt top layer to a corner edge of the cover fabric layer.

2. The quilt top mattress of claim 1 wherein the convoluted foam cushion is of polyethylene foam construction.

3. The quilt top mattress of claim 1 further comprising an insert layer disposed between the cover fabric layer and the quilt top layer, the insert layer comprising a second convoluted foam cushion having a planar inner surface and a convoluted outer surface.

4. The quilt top mattress of claim 3 wherein said second convoluted foam cushion is of polyethylene foam construction.

5. The quilt top mattress of claim 3 wherein said second convoluted foam cushion is of latex foam construction.

6. The quilt top mattress of claim 1 further comprising an inner convoluted foam cushion disposed between the spring unit and the cover fabric layer having an inner planar surface and a convoluted outer surface.

7. The quilt top mattress of claim 1 wherein the convoluted foam cushion comprises:

an elongate body including area formed by generally longitudinally extending ribs arranged in rows, with each rib separated from any adjacent rib by a channel, wherein each rib includes a plurality of first peaks having a first height and a plurality of second peaks having a second height, different from the first height, with the first and second peaks being alternatingly disposed along each rib.

8. The quilt top mattress of claim 7 wherein each rib is generally sinusoidal about a longitudinal axis to define sinusoidal channels therebetween.

9. The quilt top mattress of claim 8 wherein the first peaks are formed at crests of the sinusoidal ribs, and wherein the second peaks are formed at the longitudinal axis of each rib.

10. The quilt top mattress of claim 7 wherein the ribs are wider in areas proximate the first and second peaks.

11. The quilt top mattress of claim 7 wherein the first and second peaks are rounded.

12. The quilt top mattress of claim 7 wherein the first height is greater than the second height.

13. The quilt top mattress of claim 7 wherein the channels have a first thickness in areas proximate the first peaks and a second thickness in areas proximate the second peaks.

14. The quilt top mattress of claim 13 wherein the second thickness is greater than the first thickness.

15. The quilt top mattress of claim 1 wherein the convoluted cushion comprises:

an elongate rectangular body defined by seven rectangular longitudinally spaced zones comprising alternating support zones and comfort zones wherein the support zones provide a first amount of support, and wherein the comfort zones provide a second amount of support, with the first amount of support being greater than the second amount of support.

16. The quilt top mattress of claim 15 wherein said cushion is bi-directional.

17. The quilt top mattress of claim 15 wherein the support zones are formed by generally longitudinally extending ribs arranged in rows, with each rib separated from any adjacent rib by a channel, wherein each rib includes a plurality of first peaks having a first height and a plurality of second peaks having a second height, with the first and second peaks being alternatingly disposed along each rib.

18. The quilt top mattress of claim 17 wherein each rib is generally sinusoidal about a longitudinal axis to define sinusoidal channels therebetween.

19. The quilt top mattress of claim 18 wherein the first peaks are formed at crests of the sinusoidal ribs, and wherein the second peaks are formed at the longitudinal axis of each rib.

20. The quilt top mattress of claim 17 wherein the ribs are wider in areas proximate the first and second peaks.

21. The quilt top mattress of claim 17 wherein the first and second peaks are rounded.

22. The quilt top mattress of claim 18 wherein the first height is greater than the second height.

23. The quilt top mattress of claim 22 wherein the channels have a first thickness in areas proximate the first peaks and a second thickness in areas proximate the second peaks.

24. The quilt top mattress of claim 17 wherein the comfort zones are formed by a plurality of third peaks having a third height, the third peaks being arranged in rows, with each of the third peaks separated from any adjacent third peak in the same row by a valley, with the third peaks in adjacent rows being staggered to form a checkerboard pattern.

25. The quilt top mattress of claim 24 wherein the third peaks are rounded.

26. The quilt top mattress of claim 24 wherein the second height is greater than the third height.

27. The quilt top mattress of claim 26 wherein the valleys in the comfort zones have a thickness greater than thickness of channels in the support zone.

* * * * *